US006928931B1

(12) United States Patent
Biserød

(10) Patent No.: US 6,928,931 B1
(45) Date of Patent: Aug. 16, 2005

(54) RELEASE MECHANISM IN MISSILE

(75) Inventor: Hans B. Biserød, Raufoss (NO)

(73) Assignee: Nammo Raufoss AS, Raufoss (NO)

( * ) Notice: Subject to any disclaimer, the term of this patent is extended or adjusted under 35 U.S.C. 154(b) by 6 days.

(21) Appl. No.: 10/009,281

(22) PCT Filed: Jun. 2, 2000

(86) PCT No.: PCT/NO00/00191

§ 371 (c)(1),
(2), (4) Date: Apr. 19, 2002

(87) PCT Pub. No.: WO00/75601

PCT Pub. Date: Dec. 14, 2000

(30) Foreign Application Priority Data

Jun. 4, 1999 (NO) ..... 19992739
Oct. 21, 1999 (NO) ..... 19995140

(51) Int. Cl.[7] ..... F42B 15/10
(52) U.S. Cl. ..... 102/377; 102/253
(58) Field of Search ..... 102/377, 489, 102/253

(56) References Cited

U.S. PATENT DOCUMENTS 2,655,105 A * 10/1953 Hansche ..... 102/377
3,439,615 A * 4/1969 Forman et al. ..... 102/253
3,457,861 A * 7/1969 Crockett ..... 102/377
3,477,333 A * 11/1969 Boyd et al. ..... 102/377
4,628,821 A * 12/1986 Madderra et al. ..... 102/377
5,003,881 A * 4/1991 Herold et al. ..... 102/253
5,431,106 A * 7/1995 Dunn et al. ..... 102/377

FOREIGN PATENT DOCUMENTS

| | | |
|---|---|---|
| DE | 2036746 | 1/1972 |
| EP | 0 151 676 | 8/1985 |
| FR | 2 650 639 | 2/1991 |
| SE | 508 072 | 8/1998 |

* cited by examiner

*Primary Examiner*—Harvey E. Behrend
(74) *Attorney, Agent, or Firm*—Knobbe, Martens, Olson & Bear, LLP

(57) ABSTRACT

A release mechanism between a projectile and a rocket motor in a missile. The projectile releases from the rocket motor during flight of the missile when the rocket motor burns out and aerodynamic retardation commences. The front end of the rocket motor comprises a forward closure, a lock retainer received and movable within the forward closure, at least one lock, at least one spring that biases the lock against the lock retainer in a direction opposite the to the direction of motion of the missile. The rear end of the projectile has a central boss surrounded by the forward closure of the rocket motor, wherein the boss comprises recesses or a circumferential groove in which the at least one lock lies and keeps the forward closure and the boss axially together.

14 Claims, 5 Drawing Sheets

RELEASE MECHANISM IN MISSILE

This application is a national phase in the United States of the international application PCT/NO00/00191 filed Jun. 2, 2000 and claims the benefit of Norwegian applications 1999 2739 filed Jun. 4, 1999 and 1999 5140 filed Oct. 21, 1999. This application is related to U.S. Pat. No. 6,640,720 entitled "TRANSLATION AND LOCKING MECHANISM IN A MISSILE" issued Nov. 4, 2003, U.S. Pat. No. 6,659,393 entitled "RETARDING AND LOCK APPARATUS AND METHOD FOR RETARDATION AND INTERLOCKING OF ELEMENTS" issued Dec. 9, 2003, and U.S. Pat. No. 6,647,889 entitled "PROPELLING DEVICE FOR A PROJECTILE IN A MISSILE" issued Nov. 18, 2003, all filed concurrently herewith.

BACKGROUND OF THE INVENTION

1. Field of the Invention

The present invention relates to a release mechanism between a projectile and a rocket motor in a missile, where the projectile releases from the rocket motor during the flight thereof when the rocket motor is burned out and retardation occurs.

2. Description of the Related Art

The release mechanism according to the invention is developed for use in missiles, and in particular, but not exclusively, in rocket accelerated penetrators. Rocket accelerated penetrators are often kept in their storing and standby state with the main parts thereof not assembled. This means that the part having control fins, the fin cone, and the rocket motor proper is assembled to the penetrator at the moment before the missile is launched from the launcher. The penetrator, which is in form of an arrow like body having substantial mass, is lying in standby position in a translation tube within the rocket motor and with the pointed end thereof supported in the control fin part. How the assembly operation happens is more detailed described in the U.S. Pat. No. 6,659,393 issued Dec. 9, 2003.

During launching preparations the penetrator is translated through the translation tube and the control fin part, and the rear end of the penetrator is interlocked to the control fin part immediately before the rocket motor is ignited. It is common practise that the rocket motor is separated from the penetrator during the flight thereof as soon as the rocket motor is burned out and has lost its propelling force. It is the mechanism for this separation between the penetrator, and more generally the projectile, and the rocket motor the present application deal with.

SUMMARY OF THE INVENTION

According to the invention, a release mechanism of the introductorily described kind is provided, which is distinguished in that the rocket motor in the front end thereof comprises a forward closure, one in the forward closure received and movable locking means retainer, at least one locking means, at least one spring means that acts against the locking means retainer in a direction opposite to the direction of motion for the missile, and that the projectile in the rear end thereof has a central boss surrounded by said forward closure of the rocket motor, where the boss comprises recesses or a circumferential groove in which the at least one locking means is lying and keeps the forward closure and boss axially together.

As a practical and convenient embodiment of the invention, the locking means is in form of a ball. However, one acknowledges that the locking means may appear in form of a rod, a chip, a lug, a button or the like.

In one embodiment the locking means retainer can be a retaining ring having continuous internal retainer race. Optionally, the retaining ring can have a number of axially projecting locking means retainers, such like ball retainers. Preferably, the central boss is hollow cylindrical. In order to facilitate the manufacture and assembly of the forward closure of the rocket motor, the forward closure may advantageously be assembled of several components.

It is to be understood that the release mechanism is activated as soon as the rocket motor is burnt out and retardation of the missile occurs. This retardation activates the ball retainer ring, which, due to the inertia thereof, moves forward against the spring means and depresses the spring means. By the relative forward motion of the ball retainer ring in respect of the boss on the projectile and the balls, the balls are released radially outwards such that the balls can pass out of the recesses or the groove. Thus the locking between the forward closure and the boss ceases, and the penetrator, or the projectile, separates from the rocket motor.

Other and further objects, features and advantages will appear from the following description of one for the time being preferred embodiment of the invention, which is given for the purpose of description, without thereby being limiting, and given in context with the appended drawings where:

DETAILED DESCRIPTION OF THE PREFERRED EMBODIMENTS

The description is related to a missile in form of a penetrator and a rocket motor, but the invention is not limited to a penetrator only. Any projectile, with or without warhead, can together with a rocket motor use the release mechanism according to the invention.

Figure 1:
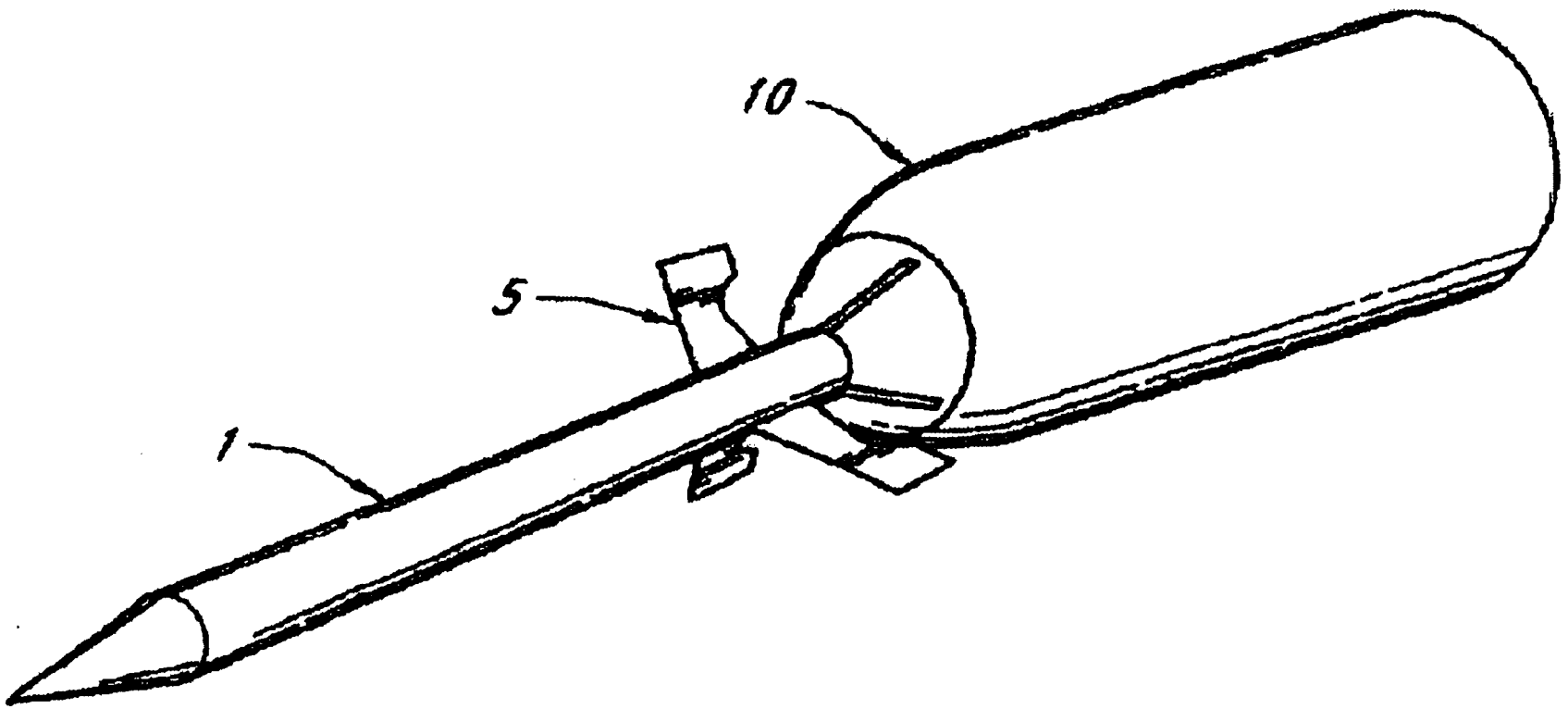
FIG. 1 shows schematically a rocket accelerated penetrator.

We firstly refer to FIG. 1 that illustrates a missile in flight. The missile comprises a penetrator 1, a control fin part 5 and a rocket motor 10 as main components. The penetrator 1 is an arrow like body having substantial mass, preferably of tungsten or depleted uranium. A penetrator is a projectile omit warhead and do achieve its destructive effect owing to the kinetic energy thereof.

Figure 2:
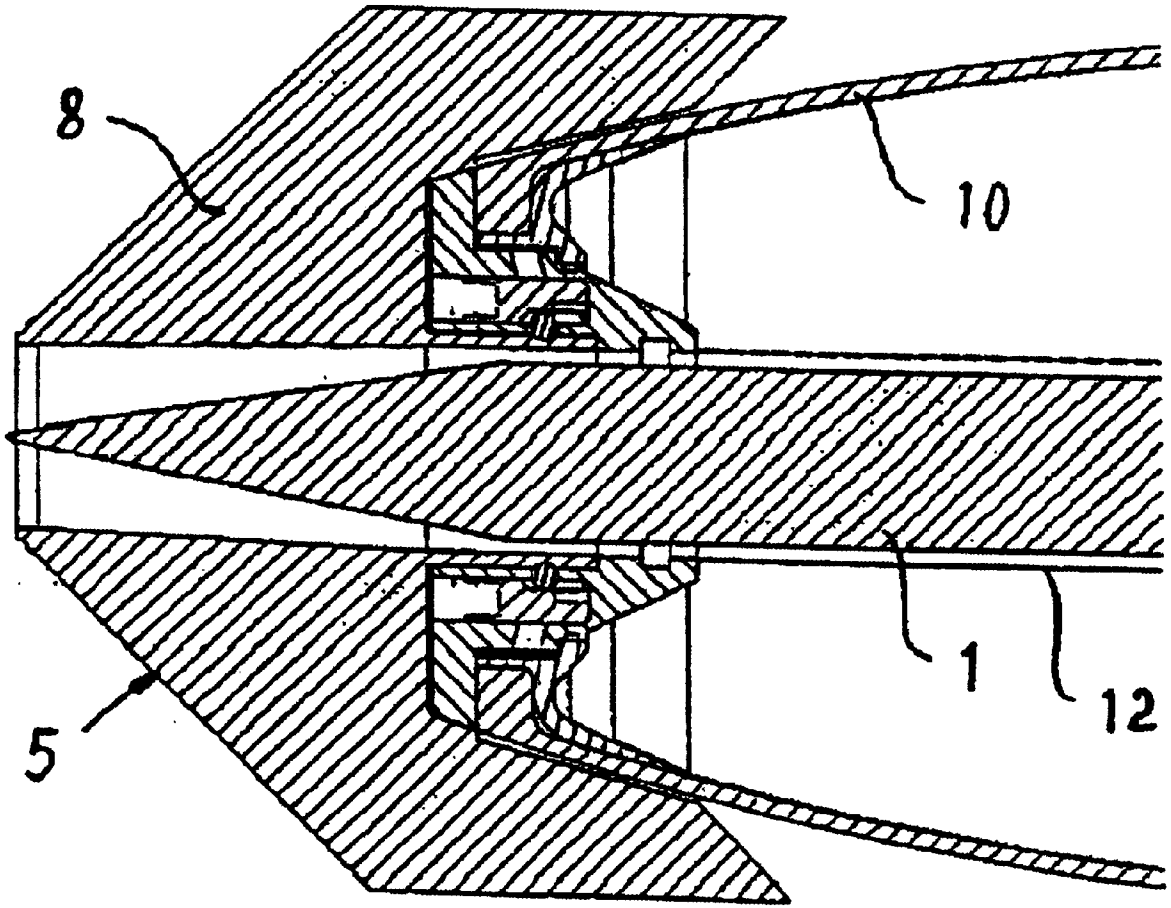
FIG. 2 shows the front end of a penetrator in the storing position thereof inside a control fin part and a rocket motor.

FIG. 2 shows the forward pointed end of the penetrator 1 in the way it is lying in standby position in the control fin part 5 and within a translation tube 12 centrally located in the rocket motor 10 during storage until launching, or ready for launching from a launching pipe or launcher (not shown). FIG. 2 is, however, a preliminary and incomplete drawing in respect of the components that are included in the release mechanism according to the invention and the finite embodiment is described in context with FIGS. 3 and 4 below.

The penetrator 1 is held axially in place within the rocket motor 10 by a closure means (not shown) having a cap that can be opened or burst away.

The reference number 8 refers to one of four control fins that are located circumferentially about a centre and having equal pitch or angular distance from each other. The number of fins 8 can vary according to desire. The rocket motor 10 is, as mentioned, releasable fixed to the control fin part 5. The rocket motor 10 is released and does separate from the control fin part 5 during the flight of the missile when a powder charge within the rocket motor 10 is burned out and retardation occur.

The propulsion means for translation of the projectile through the translation tube within the rocket motor is described in closer detail in U.S. Pat. No. 6,647,889 issued Nov. 18, 2003. The mechanism for translation of the projectile and subsequent locking to the rocket motor is described in closer detail in U.S. patent 6,640,720 issued Nov. 4, 2003.

Figure 3:
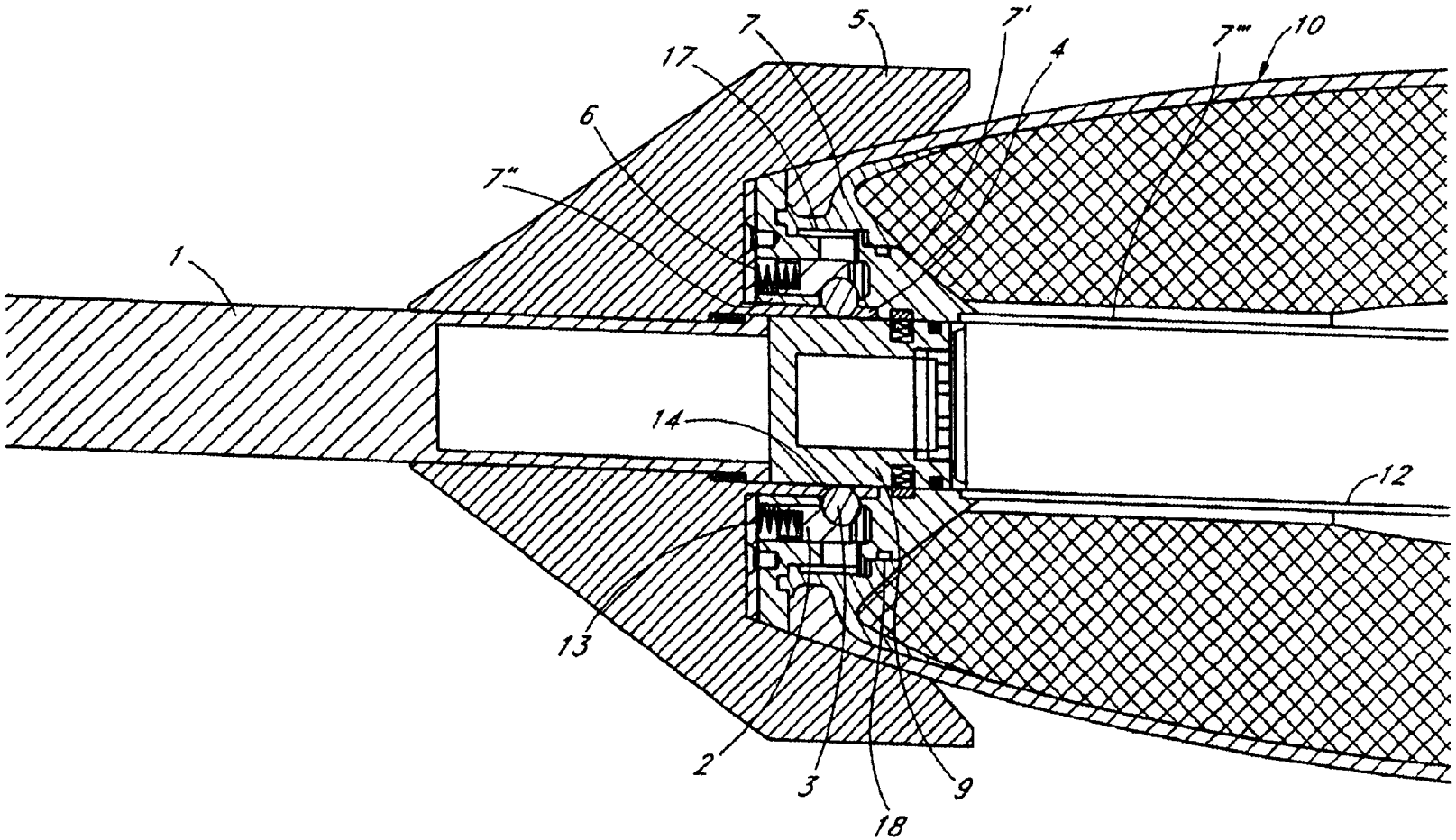
FIG. 3 shows the rear end of a translated penetrator after the penetrator has been interlocked to a control fin part and a rocket motor.

FIG. 3 shows the rear end of the penetrator 1 when the penetrator is translated through the control fin part 5. The rear end of the penetrator 1 interlocks to the control fin part 5 after this translation. How this happen is described in closer detail in U.S. Pat. No. 6,659,393 issued Dec. 9, 2003.

The front end of the rocket motor 10 is basically mounted to the control fin part 5 by means of the release mechanism according to the invention. The connection between the control fin part 5 and the front end of the rocket motor 10 occurs via a boss 4 in form of a tubular and rearwards directed extension of the rear and central end of the control fin part 5. The boss 4 does either have a number of recesses 14 (as clearly shown in FIG. 4) or a circumferential groove (not shown), which receive a number of balls 3. The recesses 14, or the groove, are adapted to the configuration and dimension of the balls 3.

The front end of the rocket motor 10 form a forward closure that includes a forward polar boss 7, to which the outer shell of the rocket motor 10 is fixed, and a forward motor closure 7'. The forward motor closure 7' is threaded into the polar boss 7 via a thread connection 17 and a seal 18, in form of an O-ring, is located between the boss 7 and the motor closure 7'. The motor closure 7' has an internal forward extending tubular part 7" that is an integrated part of the motor closure 7'. The motor closure 7' does also have a rearward extending and conical configured pipe piece 7'" that supports and fixates the translation tube 12.

The motor closure 7' surrounds the boss 4 of the control fin part 5 and the balls 3. A ball retainer ring 2 is received in the motor closure 7' and is initially located such that the retainer ring 2 encloses the balls 3 and keeps the balls 3 radially and axially in place in their respective recesses 14. The balls 3 thus act as the locking connection between the control fin part 5 and the rocket motor 10. The ball retainer ring 2 is axially slideable and is biased by a spring means 6 in a direction opposite to the direction of movement for the missile. The spring means 6 can be one or more coil springs, Belleville springs or per se any kind of spring means able to perform the intended function. In the opposite end the spring means 6 abut against an end cap 13, which is fixedly threaded to the motor closure 7'. The material of the tubular part 7" is of a certain thickness. The total amount of the thickness of the tubular part 7" and the depth of the recesses 14 must be less than the radius of the ball 3.

Figure 4:
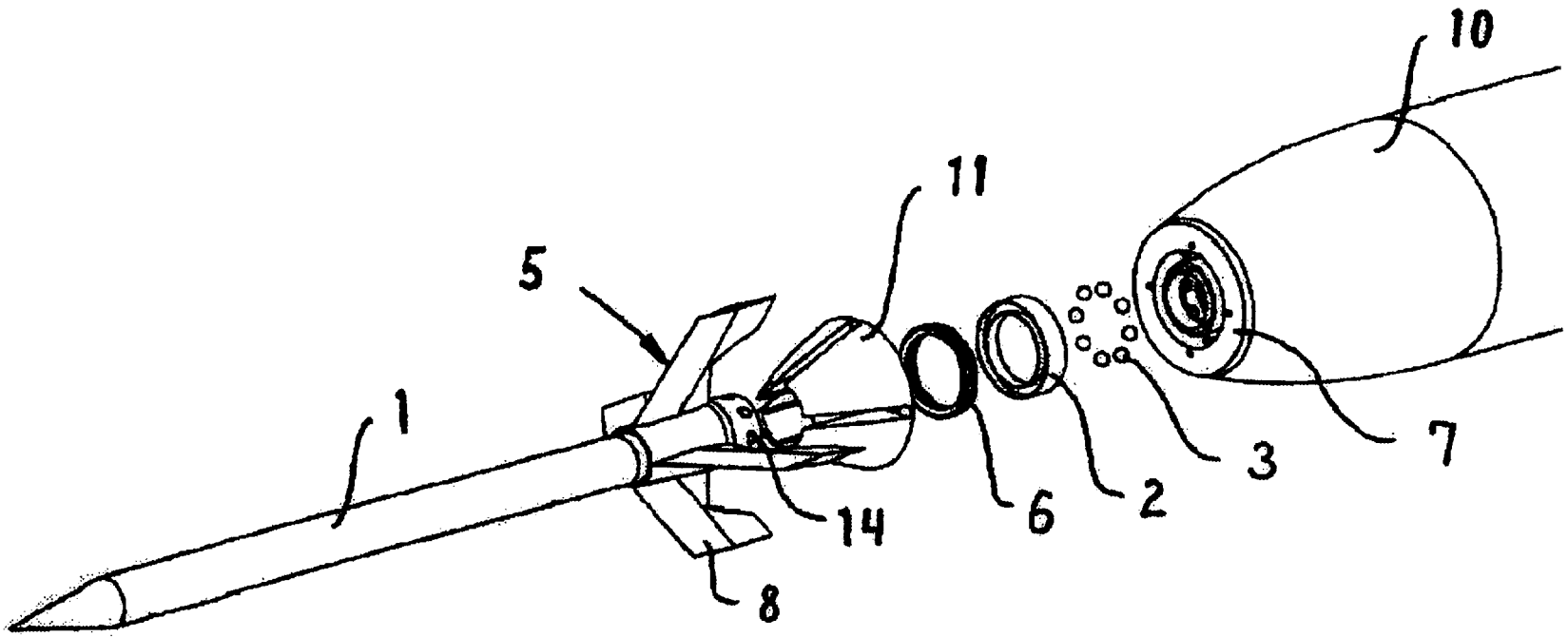
FIG. 4 shows schematically and in exploded view the rocket accelerated penetrator.

FIG. 4 shows the missile with the parts apart. After that the release mechanism has performed the mission thereof, it is the penetrator 1 and the control fin part 5 that continue the flight while the remaining parts are falling off. The reference number 11 shows an ogive that serves as a flow element in the transition between the control fins 8 and the front end of the rocket motor 10. The ogive 11 also restrict relative rotation between the penetrator 1 and the rocket motor 10. After the rocket motor 10 is burnt out, the ogive has carried out its mission and does release from the control fin part 5 together with the rocket motor 10, the polar boss 7, the motor closure 7', the spring or springs 6, the ball retainer ring 2, the balls 3 and a propulsion piston 9 for translation of the penetrator 1 within the rocket motor 10.

As mentioned introductorily does the release mechanism come into force as soon as the rocket motor 10 is burnt out and retardation of the missile occurs. This retardation activates the ball retainer ring 2, which, due to the inertia thereof, moves forward against the springs 6 and compresses the springs 6. By the relative motion forward of the ball retainer ring 2 in respect of the boss 4 on the projectile 1 and the balls 3, the balls 3 are released radially outwards such that the balls can pass out of the recesses 14. When the balls 3 not any longer are axially retained, the motor closure 7' will move axially in respect of the boss 4 and the boss 4 will thus push the balls 3 out of the recesses 14. Thus the locking between the motor closure 7' and the boss 4 ceases and the rocket motor 10 does part from the penetrator 1 or projectile. If the missile is of the kind that rotates about its own axis, the rotation will provide centrifugal forces to the balls 3 that contribute to additional force in outwards radial direction.

In FIG. 4 is the ball retainer ring 2 shown in an embodiment having a circumferential continuous ball retainer race in the same way as an outer race in a ball bearing.

Figure 5:
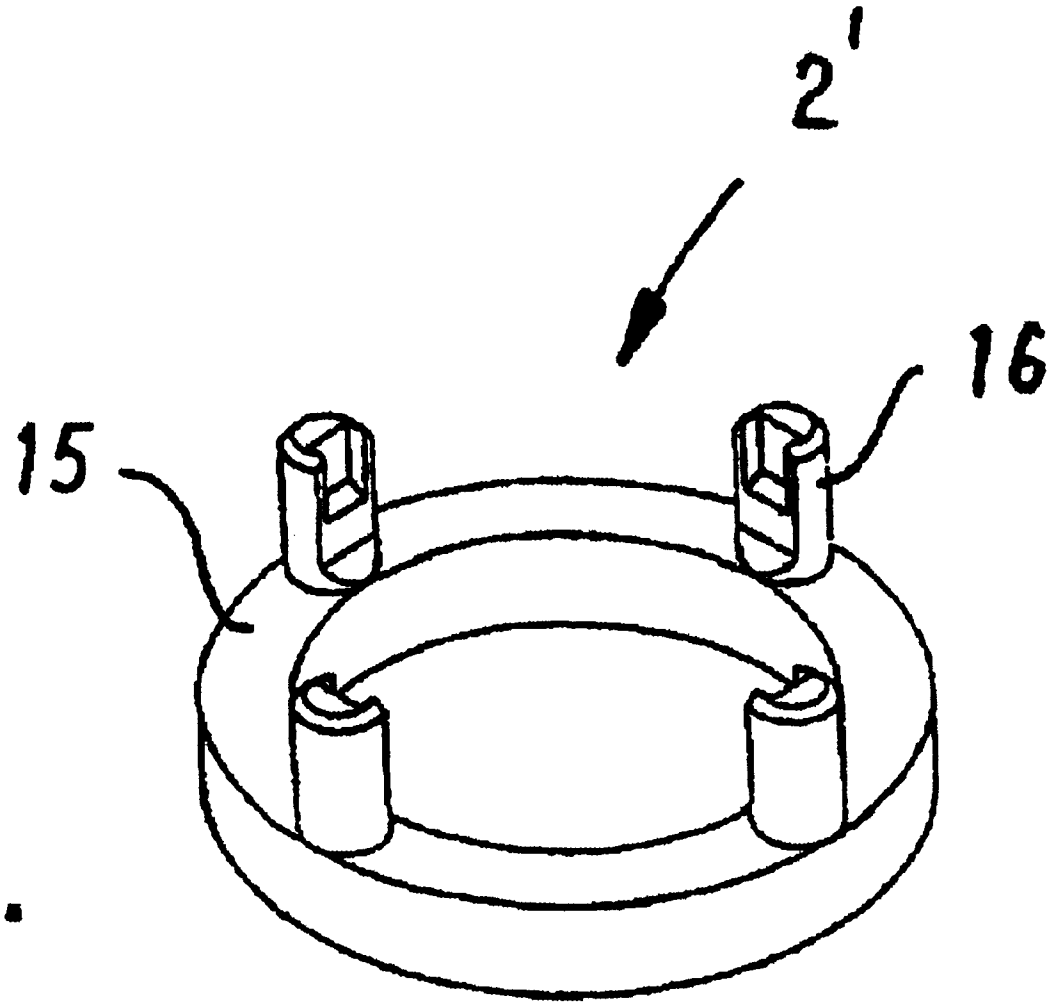
FIG. 5 shows one embodiment of the locking means retainer.

FIG. 5 shows an alternative embodiment of a ball retainer ring 2'. Four ball retainers 16 project in an axial direction out from an annular part 15. The number of ball retainers 16 can vary according to need. As in the first embodiment, the boss 4 can have an external circumferential groove adapted to the dimension of the balls 3, or a number of recesses 14 adapted to the dimension of the balls 3 and correspond with the number of balls 3, as illustrated in FIG. 4.

In the drawings balls 3 are shown as the locking means. Even if balls are preferred, it will be possible to use locking means in form of rods, chips, lugs, buttons etc. It will also be possible to provide a spring underneath the locking means that inherently bias the locking means radially outwards and is released when the retainer for the locking means moves axially forward.

What is claimed is:

1. A release mechanism between a projectile and a rocket motor in a missile, wherein the rocket motor in the front end thereof comprises a forward closure, one lock retainer ring received in the forward closure so as to be axially movable, at least one lock, and at least one spring that biases against the lock retainer ring in a direction opposite to the direction of travel for the missile, and wherein the projectile in the rear end thereof has a central boss surrounded by the forward closure of the rocket motor, wherein the boss comprises recesses in which the at least one lock lies and keeps the forward closure and boss axially together, and wherein, when the rocket motor burns out, retardation occurs including the lock retainer ring to move forward so as to release the at least one lock and release the projectile from the rocket motor.

2. The release mechanism of claim 1, wherein the lock is in the form of a ball.

3. The release mechanism of claim 1, wherein the lock is in the form of a rod, a chip, a lug, or a button.

4. The release mechanism of claim 1, wherein the lock retainer comprises a retaining ring having a continuous internal retainer race.

5. The release mechanism of claim 4, wherein the lock retainer comprises a ball retaining ring having a continuous internal ball retainer race.

6. The release mechanism of claim 1, wherein the lock retainer ring comprises a number of separated, axially projecting retainers.

7. The release mechanism of claim 6, wherein the lock retainer ring comprises an annular part and a number of separated, axially projecting ball retainers.

8. The release mechanism of claim 1, wherein the boss is hollow and cylindrical.

9. The release mechanism of claim 1, wherein the forward closure comprises a polar boss and a forward motor closure that are threaded together and a seal interposed therebetween.

10. The release mechanism of claim 1, wherein the projectile is a penetrator.

11. A missile comprising:

a rocket motor that includes a casing wherein the rocket motor propels the missile;

a projectile that is coupled to the rocket motor and is separable therefrom; and a release mechanism interposed between the projectile and the rocket motor wherein the release mechanism includes:

at least one locking member;

a locking member retainer that couples the at least one locking member to both the projectile and the rocket motor; and a spring biasing member that engages with the locking member retainer so as to maintain the at least one locking member in engagement between the rocket motor and the projectile, wherein the spring biasing member is biased in the direction opposite the motion of the missile such that when the rocket motor ceases propelling the missile, the force of the spring biasing member is inertially overcome thereby allowing the locking member retainer to move forwards so as to decouple the at least one locking member between the projectile and the rocket motor thereby releasing the projectile from the rocket motor.

12. The missile of claim 11, wherein, when the rocket motor burns out, retardation induces the movable locking member retainer to inertially compress the spring biasing member thereby permitting the at least one locking member to disengage between the projectile and the rocket motor.

13. The missile of claim 12, wherein the missile includes one or more recesses in which the at least one locking members are captured, wherein the spring biasing member engages with the movable locking member retainer so as to retain the at least one locking members within the recesses to secure the projectile and rocket motor together.

14. The missile of claim 13, wherein the at least one locking member comprises a plurality of balls positioned within corresponding recesses.

* * * * *

UNITED STATES PATENT AND TRADEMARK OFFICE

CERTIFICATE OF CORRECTION

PATENT NO. : 6,928,931 B1
DATED : August 16, 2005
INVENTOR(S) : Hans B. Biserød

It is certified that error appears in the above-identified patent and that said Letters Patent is hereby corrected as shown below:

Title page,
Item [57], ABSTRACT,
Line 8, after “opposite” delete “the”.

Column 4,
Line 63, delete “including” and insert -- inducing --.

Signed and Sealed this

Twenty-eighth Day of February, 2006

JON W. DUDAS
*Director of the United States Patent and Trademark Office*